US011692377B2

(12) United States Patent
Casal Gomez et al.

(10) Patent No.: US 11,692,377 B2
(45) Date of Patent: Jul. 4, 2023

(54) OPENING CONTROL DEVICE WITH AN INERTIAL SAFETY BLOCKING

(71) Applicant: AKWEL VIGO SPAIN S.L, Vigo Pontevedra (ES)

(72) Inventors: Javier Casal Gomez, Vigo (ES); Alberto Diez Estevez, Pontevedra (ES); Delmiro Javier Couto Maquieira, Pontevedra (ES)

(73) Assignee: AKWEL VIGO SPAIN S.L, Vigo Pontevedra (ES)

( * ) Notice: Subject to any disclaimer, the term of this patent is extended or adjusted under 35 U.S.C. 154(b) by 777 days.

(21) Appl. No.: 16/359,538

(22) Filed: Mar. 20, 2019

(65) Prior Publication Data

US 2019/0301213 A1 Oct. 3, 2019

(30) Foreign Application Priority Data

Mar. 27, 2018 (FR) ..... 18/70354

(51) Int. Cl.

| | |
|---|---|
| ***E05B 77/04*** | (2014.01) |
| ***E05B 85/10*** | (2014.01) |
| ***E05B 81/76*** | (2014.01) |
| ***E05B 77/06*** | (2014.01) |
| *E05B 81/02* | (2014.01) |

(52) U.S. Cl.

CPC ..... *E05B 85/103* (2013.01); *E05B 77/06* (2013.01); *E05B 81/76* (2013.01); *E05B 81/02* (2013.01); *E05Y 2900/531* (2013.01); *Y10S 292/22* (2013.01)

(58) Field of Classification Search

CPC ..... E05B 77/02; E05B 77/04; E05B 77/06; E05B 85/10; E05B 85/103; E05B 81/02; E05B 81/76; Y10S 292/22

See application file for complete search history.

(56) References Cited

U.S. PATENT DOCUMENTS 3,719,248 A * 3/1973 Breitschwerdt ..... E05B 77/06 180/271

6,070,923 A 6/2000 Tanimoto et al.

(Continued)

FOREIGN PATENT DOCUMENTS

CN 108505851 A * 9/2018

DE 102009046380 A1 * 5/2011 ..... E05B 77/06

(Continued)

*Primary Examiner* — Carlos Lugo

(74) *Attorney, Agent, or Firm* — Oliff PLC

(57) ABSTRACT

An opening control device including a base, a handle lever configured to be pivotally mounted on the base about a handle axis, a kinematic chain configured to transmit a movement from the handle lever toward a latch of the opening control device to unlock the door leaf, the chain including at least one active branch of the handle lever, an inertial safety member including a main body forming an inertial mass and a blocking element linked to the body and configured to prevent by wedging the transmission of movement by the kinematic chain. According to the invention, the inertial member is kinematically coupled to the secondary branch of the handle lever and extends on the side of the secondary branch with respect to the handle axis opposite to a gripping main branch.

16 Claims, 9 Drawing Sheets

(56) References Cited

U.S. PATENT DOCUMENTS

| | | | | |
|---|---|---|---|---|
| 7,036,857 | B2 * | 5/2006 | Ichino | E05B 85/12 292/336.3 |
| 7,568,744 | B2 * | 8/2009 | Tenorio | E05B 77/06 292/336.3 |
| 7,677,614 | B2 * | 3/2010 | Monig | E05B 77/38 292/336.3 |
| 8,167,342 | B2 * | 5/2012 | Bertolotti | E05B 77/06 292/336.3 |
| 8,424,936 | B2 * | 4/2013 | Muller | E05B 77/06 292/336.3 |
| 2002/0020039 | A1 * | 2/2002 | Spurr | E05B 85/12 16/412 |

FOREIGN PATENT DOCUMENTS

| | | | | | |
|---|---|---|---|---|---|
| DE | 102011051328 | A1 * | 12/2012 | | E05B 77/06 |
| DE | 102017103472 | A1 * | 8/2018 | | E05B 77/06 |
| EP | 1593802 | A1 * | 11/2005 | | E05B 77/06 |
| EP | 3 067 494 | A1 | 9/2016 | | |
| FR | 2 871 500 | A1 | 12/2005 | | |
| FR | 2876135 | A1 * | 4/2006 | | E05B 85/16 |
| FR | 2944547 | A1 * | 10/2010 | | E05B 85/18 |
| JP | 2016-210387 | A | 12/2016 | | |
| JP | 2017-031739 | A | 2/2017 | | |
| WO | WO-2004059112 | A1 * | 7/2004 | | E05B 77/06 |
| WO | WO-2010049311 | A1 * | 5/2010 | | E05B 77/04 |
| WO | 2010/133372 | A1 | 11/2010 | | |

* cited by examiner

OPENING CONTROL DEVICE WITH AN INERTIAL SAFETY BLOCKING

The present invention relates to a safety device for an opening control device of a door leaf such as a door of a motor vehicle. More specifically but not exclusively, the invention applies particularly to the field of safeguarding a motor vehicle from an impact caused by an accident.

There are known handles for a door leaf of a vehicle, provided with a safety device allowing avoiding, in case of accident, the opening of the door leaf by the deceleration undergone by the gripping portion of the handle.

In general, the closure of a door leaf, for example a door of the vehicle, is achieved by means of a latch comprising a bolt secured to the door adapted to cooperate with a striker secured to the body. During the opening from outside the vehicle, the bolt is released from the striker by actuating a system known as «external opening control device» or «EOC». Such a system comprises a handle which, when maneuvered in traction by a user, causes unlocking of the latch.

The action exerted on the handle, translates, through a kinematic chain of the EOC, into the release of the bolt from the striker and therefore the opening of the door. When the user releases the handle, the latter is brought back into the rest position by a return spring.

There is also inside the vehicles an opening system called «internal opening control device» or «IOC» whose kinematic chain is of the same type as that of the EOC, but generally independent from the latter.

In the absence of any safety device, it is understood that during a lateral impact, the inertial force related to the mass of the handle may reach, and even exceed, the traction force usually necessary to open the door. Indeed, a lateral impact is likely to develop on the handle instantaneous accelerations with high magnitudes. Hence, the magnitude of the generated inertial forces may be considerable, even with light handles.

Besides, the stiffness of the return spring of the handle is of course quite insufficient to resist the opening load exerted by the inertial force applied to the handle.

A first safety device solution proposed in the state of the art consists of a device with a counterweight and a return spring. The counterweight is mounted on an axis to which the handle is also linked, to impart on the axis, during a lateral impact, an inertial torque opposite to that of the inertial force applied to the handle. Hence, this safety device acts by inertia compensation yet without resisting the normal opening movement of the door because in this case these consist of slow movements with low acceleration. When a user pulls on the handle to open the door, it drives at the same time the counterweight of the safety device, which is then brought back into its initial position by the return spring when the user releases the handle.

An advantage of this first solution is that it is inexpensive, but it still has numerous other drawbacks. In particular, the presence of the counterweight increases the bulk of the external opening control system across the thickness of the door and adds weight to the vehicle with non-functional masses. Besides, this known safety device does not operate for very high accelerations because of the inertia of the counterweight.

A second safety device solution proposed in the state of the art is also an inertial solution, but this time operating by blocking the kinematic chain of the external opening control device. This second known safety device is constituted by an inertial mass disposed to drive, during a lateral impact, a member adapted to block for example the transmission lever of the kinematic chain thereby preventing the release of the bolt of the latch out of the striker. A return spring is present to bring the inertial mass back into its rest position.

There is also known from the document FR 2 871 500 an opening control device for a door of a motor vehicle comprising a handle pivotally mounted on a baseplate comprising a gripping branch provided at an outer end of an actuation column acting on a transmission set.

In this document, the opening control device comprises a member for locking the handle in case of accelerations caused by an accident and an elastic return member normally holding this member in a position not locking the handle. In this document, the locking member comprises a weight and two hooks linked to the weight and is mounted at the level of the actuation column.

The drawback of an opening control device according to this document is that during an impact, the handle tends to be ejected in a predefined direction of rotation and the same applies to the hooks linked to the weight which also tend to turn in the same direction of ejection of the handle. The blocking effectiveness of the locking member is then compromised and the locking of the handle becomes uncertain. Furthermore, this operating configuration is limited to a very particular design of the handle which imposes the presence of the actuation column.

The invention aims at overcoming these drawbacks and providing an opening control device with an inertial safety blocking having an enhanced sensitivity to accelerations caused by an accident.

To this end, an object of the invention is an opening control device for a door leaf of a motor vehicle comprising:

- a base of the opening control device,
- a handle lever configured to be pivotally mounted on the base about a handle axis, comprising a main gripping branch and a secondary branch for extending the main branch each located on either side of the handle axis and a center of gravity located on the side of the main branch, one of the two branches forming the active branch,
- a kinematic chain configured to transmit a movement from the handle lever toward a latch of the opening control device to unlock the door leaf, said chain comprising at least one active branch of the handle lever,
- an inertial safety member, distinct from the movable elements of the opening control device comprising the kinematic chain and the handle, comprising an inertial mass and a blocking element configured to block by inertial effect the transmission of movement by the kinematic chain, characterized in that the inertial member is kinematically coupled to the secondary branch of the handle lever and extends on the side of the secondary branch with respect to the handle axis and in that the inertial member and movably mounted on a movable element of the opening control device.

When the vehicle is hit laterally, the resulting impact subjects the movable elements of the opening control device to accelerations which translates into a displacement in a direction opposite to the impact. By their inertia, the movable elements are displaced and may transmit the movement to the latch and thus cause the unintentional opening of the door.

In particular, in the case of the invention, the inertia causes an inertial torque on the handle lever which results in displacing the center of rotation of the inertial member kinematically coupled to the secondary branch of the lever. The inertia of the handle on the inertial member added to the own inertia of the inertial member causes the rotation of the latter. The inertial member then «takes off» from its rest position to immobilize the drive kinematic chain with its blocking element against the base or an element of the kinematic chain.

On one hand, the positioning of the inertial member on a movable element of the opening control device increases the accelerations received by the inertial member which makes it more sensitive, even for low accelerations. Moreover, it is possible to design this embedded inertial member with reduced mass and dimensions.

The positioning of the inertial member at the level of an inner extension of the gripping main branch on the other side of the handle axis confers it with an enhanced reactivity. Indeed, thanks to this very specific positioning, the lever of the handle exerts on the inertial member a moment of inertia which results in making the inertial member turn in the direction opposite to that of the secondary branch.

Thus, the inertial member reacts very rapidly to the impact so that the inertial member immobilizes the kinematic chain even before the handle could actuate it.

In actual use, in the absence of lateral impact, the inertial member is in rest position and the blocking element of the inertial member preferably extends against a lower surface of the secondary branch of the lever or of another movable element kinematically linked on the side of the secondary branch.

An opening control device according to the invention may further include one or more of the following features.

Preferably, the inertial member delimits a lower profile which forms an obtuse angle such that the blocking element extends in a direction oblique with respect to the main body. The advantage achieved by this feature is enabling the inertial member to block the kinematic chain through a small angle of rotation.

For example, the inertial member has a longitudinal section according to the direction of extension of the blocking element configured in an L- or V-shape with an obtuse apex angle.

In the described example, the inertial member comprising a pivot axis to be pivotally mounted on the secondary branch, the pivot axis extends transversely to the predefined direction in an intermediate region located between the main body and the blocking element. Thus, according to this feature, the inertial mass is offset from the pivot axis in order to increase the inertial effects on the blocking element.

In a preferred embodiment of the invention, the inertial member is movably mounted directly on the secondary branch.

Preferably, the inertial member has a rest configuration folded back against a lower surface of the secondary branch and an active configuration deployed by inertial effect to project outwardly from the secondary branch. Thanks to the folded back configuration, the inertial member does not hinder the normal operation of the opening control device.

Preferably, the inertial member is mounted on a free end of the secondary branch such that the blocking element extends in a longitudinal direction of the secondary branch and the main body extends freely opposite a front-end face of the secondary branch.

For example, the inertial member comprises a first means for rotatably coupling with a complementary second rotational coupling means secured to the secondary branch.

Preferably, the blocking element is formed as a blocking tooth having a rectangular or oval general shape.

According to a particular feature, the main body comprises a housing for guiding in rotation a pivot shaft, the guide housing consists of at least one half-bearing provided with a semi-cylindrical recess.

For example, the secondary branch terminates in a lateral cheek and a pivot shaft extending transversely to the lateral cheek.

In one variant, the secondary branch terminates in two flanges supporting a rod about which the inertial member can pivot.

In a preferred embodiment of the invention, the secondary branch is provided with an elastic leaf forming a spring which can be biased along its longitudinal axis by buckling during the pivoting of the inertial member, the inertial member and the leaf being provided with first and second complementary hooking means.

For example, the first and second hooking means comprise a protrusion and a notch for receiving the protrusion, the protrusion being adapted to engage into the notch during the pivoting of the inertial member to retain the inertial member.

In a preferred embodiment of the invention, the secondary branch forming the active branch of the handle lever, the inertial member is movably mounted on an element of the kinematic chain, such as a transmission lever pivotally mounted on the base.

Preferably, the kinematic chain comprising a transmission lever pivoting about a transmission axis formed by a transmission shaft, the active branch and the transmission shaft comprise complementary coupling means in order to enable the rotational driving of the transmission shaft by the active branch.

Preferably, the inertial member comprises a surface for wedging the kinematic chain by wedging the inertial member with the base or an element of the kinematic chain.

In a preferred embodiment of the invention, the control comprises an elastic return member exerting a force on the inertial member, the latter being adapted to overcome the force exerted by the elastic return member by inertial effect.

Preferably, the inertial member is of the mono-stable type comprising a rest stable position, bi-stable and irreversible comprising two rest and active stable positions, the active position being irreversible, bi-stable and reversible comprising two rest and active stable positions, the active position being reversible.

Other features and advantages of the invention will appear in light of the following description, made with reference to the appended drawings in which.

Figure 1:
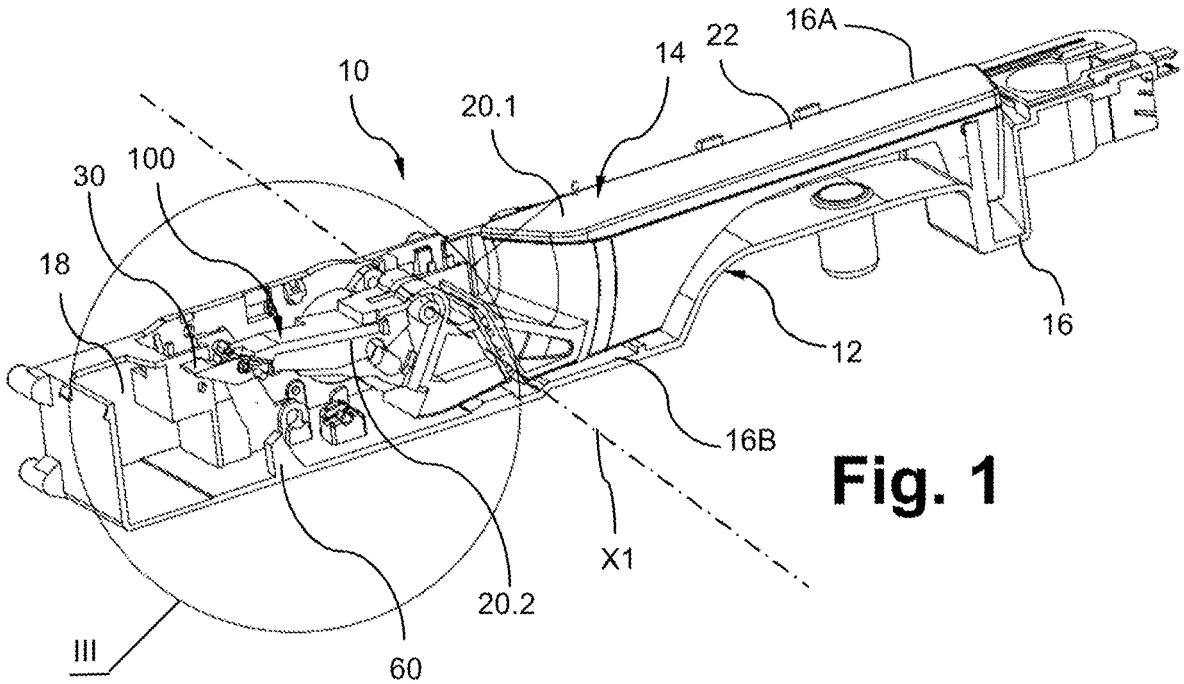
FIG. 1 represents a perspective view of an external opening control device according to a first embodiment in a retracted handle configuration.

There is schematically represented in FIGS. 1 to 9 an opening control device for a door leaf of a motor vehicle according to a first embodiment of the invention. The opening control device is referred to by the general reference 10.

The opening control device 10 is configured to be mounted on a body external panel (not represented) of a door leaf which is for example a vehicle side door. The opening control device 10 mainly includes a fixed handle support 12, also referred to as fastening base or bracket depending on the type of design of the handle, and a handle system 14 in accordance with the invention.

In service, the support 12 is configured to be fastened to the door leaf. In the illustrated example, the support 12 comprises a case 16. For example, the case 16 has a parallelepiped general shape and is adapted to be housed within a cutout or a recess of the external panel of the door leaf such that its external face 16A is flush with the surface of the external panel of the door leaf. Moreover, the case 16 is open on the side of its external face 16A and closed by a bottom surface 16B on the internal side in order to delimit a housing 18 configured to house the handle system 14.

The handle system 14 comprises a handle lever 20 configured to be pivotally mounted about a pivot axis X1 on the base 12 of the opening control device 10. In the described example, the handle lever 20 is hingedly mounted relative to the panel, about the handle geometric axis X1, on the support 12. The handle axis X1 is herein substantially vertical and parallel to the general plane of the external panel.

In the described example, the handle system 14 is of the «flush» type, that is to say that the support 12 on which the handle system 14 is movably mounted forms a cavity (not represented) adapted to completely receive the handle system 14 in the retracted configuration. In this configuration, the external surface of the handle lever 20 is flush with the external surface of the external wall of the door leaf. In the emerged or deployed configuration, the handle lever 20 emerges at least partially from the cavity of the support 12 to be able to be grasped by a user of the vehicle in order to open the door. For this purpose, the user can displace the handle lever 20 further toward the outside in order to control the latch of the door to open it.

Nonetheless, it should be understood that other movable mountings might be considered, such as in particular by pivoting about an axis located at another position or else by translation along a direction essentially perpendicular to the general plane of the door. It should also be noted that the movable mounting of the handle relative to the support is known per se to those skilled in the art.

In particular, the lever 20 is configured for gripping by a user. To this end, the lever 20 has an outer portion 20.1, or main gripping branch, that the user can grasp. Opposite to the outer portion 20.1, the lever 20 has an inner portion 20.2 which forms a secondary inner branch 20.2 for extending the main branch 20.1, which is preferably configured to extend in an invisible manner from outside the body. Conventionally, on the outer portion 20.1, the lever 20 includes a gripping paddle 22, which has a generally flat and elongate shape.

Figure 2:
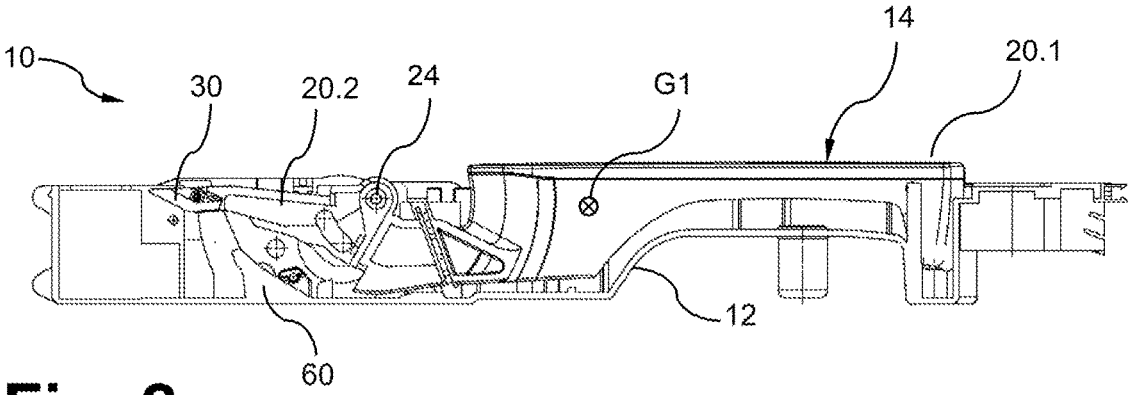
FIG. 2 represents a longitudinal sectional view of the external opening control device of FIG. 1.
Figure 3:
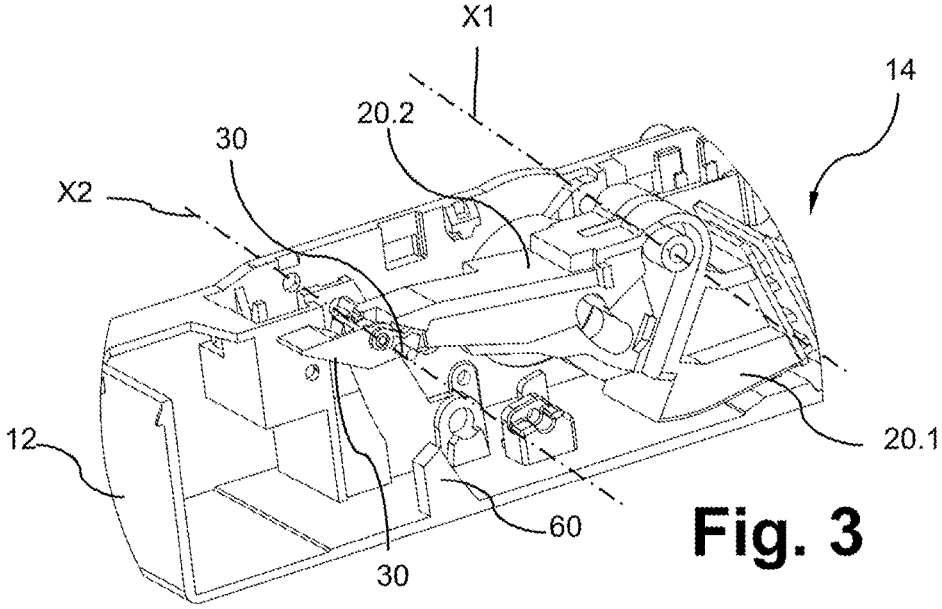
FIG. 3 represents an enlarged view of the encircled portion III of FIG. 1.

The main branch 20.1 and the secondary branch 20.2 are located on either side of the handle axis X1 of the lever 20. Furthermore, the lever 20 comprises a center of gravity G1 located on the side of the main branch 20.1. Preferably, as shown in FIG. 2, the center of gravity G1 of the lever 20 is offset from the handle axis X1.

As shown in FIG. 1, the base 16 has a case-like general shape having a housing 18 inside which the lever 20 is configured to be housed. The lever 20 is preferably movable in rotation relative to the case 16. To this end, the opening control device 10 comprises a hinge 24 about which the lever 20 is rotatably hinged about the handle axis X1.

This opening control device 10 is configured to cooperate with a latch (not represented) of the door leaf of the motor vehicle likely to adopt a locked configuration and an unlocked configuration. Conventionally, the pivoting of the lever 20 of the handle system 14 about its hinge axis X1 actuates the latch in either one of its locked or unlocked configurations via a drive kinematic chain (not represented in the figures).

In a manner known per se, the kinematic chain 100 is configured to transmit a movement from the handle lever 20 toward a latch of the opening control device to unlock the door leaf. More specifically, said chain 100 comprises at least one actuation branch or active branch of the handle lever 20. This actuation branch forms an active portion of the handle lever 20 which will drive by its movement the other elements of the chain 100 up to the latch mechanism of the opening control device 10.

Indeed, conventionally, the handle lever 20 is configured to actuate the drive kinematic chain 100 to unlock the door leaf. In this first embodiment, the actuation branch or active branch is formed by the secondary branch 20.2 of the handle lever 20 which is kinematically coupled to a transmission lever (not represented) forming another element of the kinematic chain. In this example, although not illustrated in FIGS. 1 to 9, the transmission lever is pivotally mounted about a transmission axis parallel to the handle axis in the base 12. For example, a torsion spring mounted around the transmission axis returns the transmission lever and thus the handle into the locking position.

Thus, when a user actuates the handle lever 20 by gripping the main branch 20.1, that is to say by making it pivot about its handle axis X1 in the direction F1 (FIG. 4), the handle active portion formed by the secondary branch 20.2 drives in rotation the transmission lever and makes it pivot about its transmission axis. The pivoting of the transmission lever into an unlocking position then uncocks the latch and enables the opening of the door leaf.

In accordance with the invention, the opening control device 10 further comprises an inertial safety member 30. This inertial safety member 30, hereinafter referred to as inertial member 30, is movable between a rest position in which the inertial member 30 does not block the kinematic chain 100 and an active position in which the inertial member 30 blocks the kinematic chain.

Figure 8:
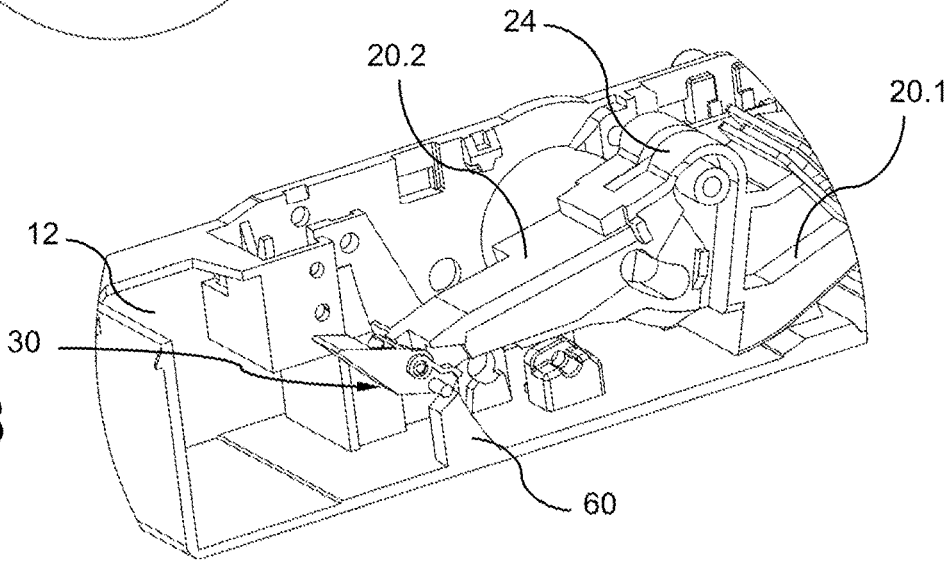

Preferably, the inertial member 30 has a rest configuration folded back against a lower surface of the secondary branch 20.2 (FIG. 3) and an active configuration deployed by inertial effect to project outwardly from the secondary branch 20.2 (FIG. 8).

Figure 9A:
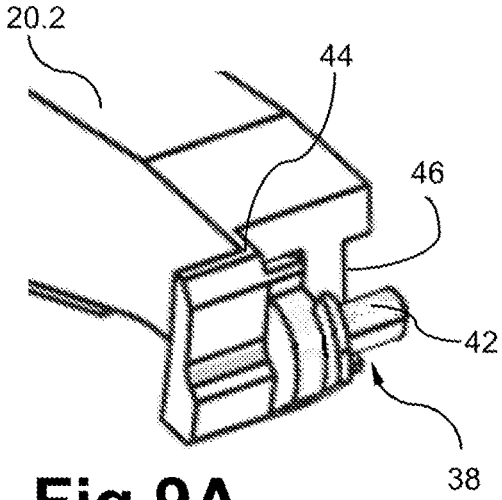
FIGS. 9A and 9B are partial enlarged views respectively of one end of the handle lever and of an inertial safety member of the opening control device according to the first embodiment of the invention.
Figure 9B:
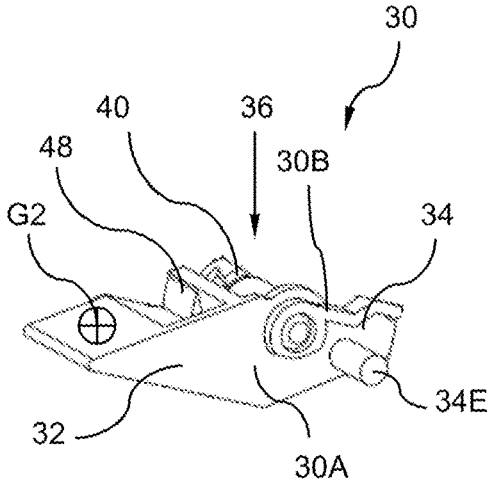
Figure 10:
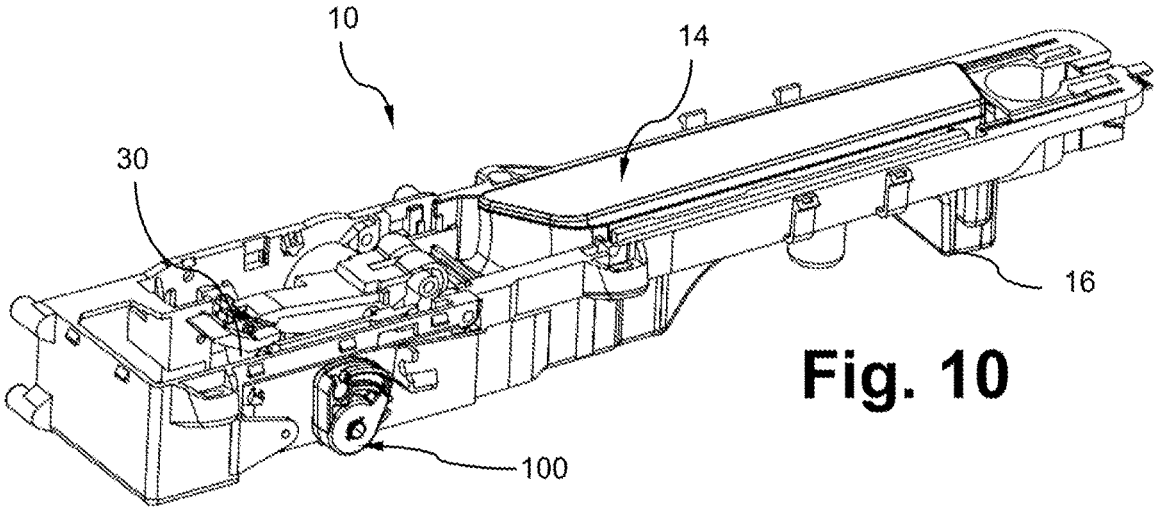
FIG. 10 represents a perspective view of an external opening control device according to a second embodiment of the invention in a retracted handle lever configuration.
Figure 11A:
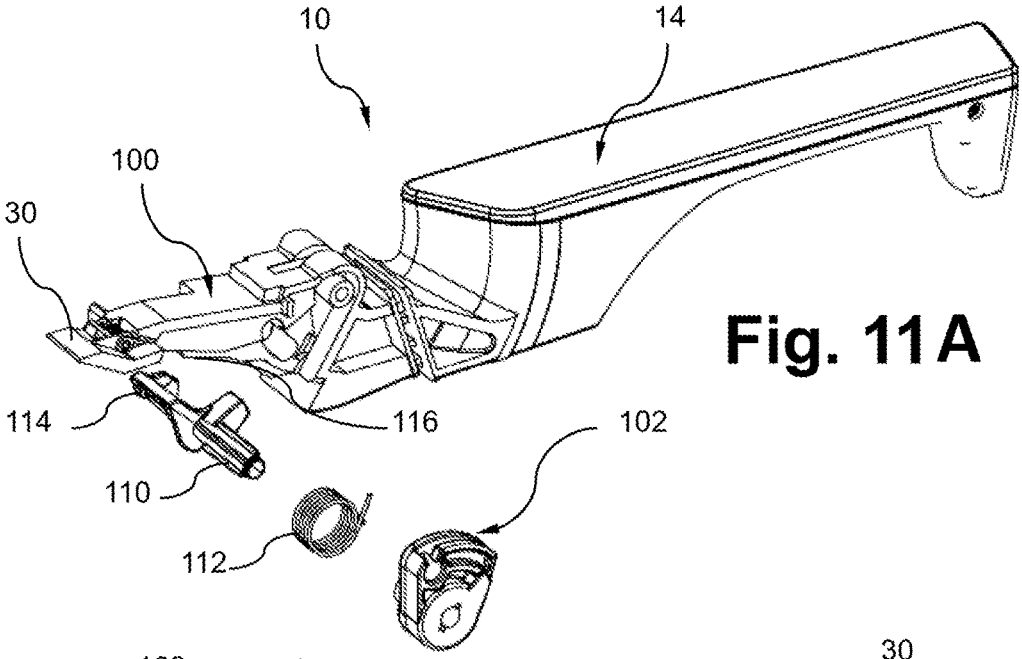
FIG. 11A represents an exploded perspective view of the handle system of the external opening control device of FIG. 10 and of a portion of a drive kinematic chain.
Figure 11B:
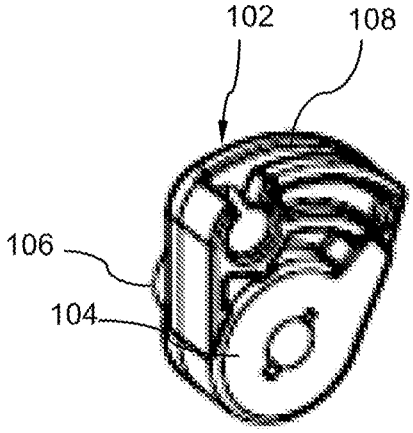
FIG. 11B represents an enlarged view of a transmission lever illustrated in FIG. 11A.
Figure 11C:
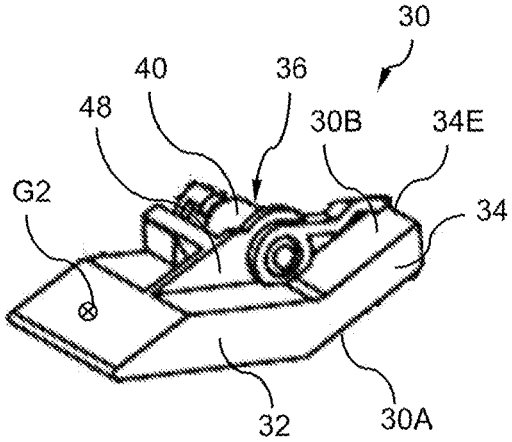
FIG. 11C represents an enlarged view of an inertial safety member illustrated in FIG. 11A.

There is represented in detail in FIG. 9B an example of an inertial member 30 of the opening control device 10 according to the first embodiment of the invention. According to the invention, this inertial member 30 comprises a main body 32 forming an inertial mass of the member 30 and a blocking element 34 configured to block the kinematic chain 100 as shown in particular in FIGS. 9A, 9B. The blocking element 34 is linked to the main body.

Preferably, the center of gravity G2 of the inertial member 30 is located at the level of the main body 32. In the example illustrated in FIG. 9B, it is shown that the inertial member 30 is made integrally in one piece.

The inertial member 30 extends according to a longitudinal main direction from the inertial mass 32 toward the blocking element 34. The inertial member 30 further delimits an upper front face 30A configured to be turned toward the end of the secondary branch 20.2 and an opposite lower back face 30B turned outwardly.

Preferably, the inertial member 30 delimits a lower profile 30A which forms an obtuse angle such that the blocking element 34 extends in a direction oblique with respect to the main body 32. Preferably, the inertial member 30 has a longitudinal section according to the direction of extension of the blocking element 34 configured in an L- or V-shape with an obtuse apex angle.

On the back face 30B side, the blocking element 34 and the main body 32 join together according to an L- or V-shaped back profile forming an obtuse angle, for example rounded or acute along a transverse edge.

On the front face 30A side, the blocking element 34 and the main body 32 join together according to an L- or V-shaped profile marked by a transverse incidence cut-edge separating the main body 32 from the extension of the blocking element 34.

For example, the material of the blocker 34 may comprise an alloy adapted for pressure casting, such as a zinc, aluminum, magnesium alloy.

In the illustrated example, the blocking element 34 includes a blocking lug 34E formed by a transverse projection 34E and configured to abut against a relief 60 of the base 12 only during the displacement of the member 30 by inertial effect and to circumvent the relief otherwise.

More particularly, the inertial member 30 is kinematically coupled to the secondary branch 20.2 of the handle lever and extends on the side of the secondary branch 20.2 with respect to the handle axis X1. In the context of the present invention, by kinematic coupling of the inertial member 30, it should be understood that it is movably secured to the secondary branch 20.2 by being directly or indirectly linked to the secondary branch 20.2. Indeed, in this first embodiment illustrated by FIGS. 1 to 9, the inertial member 30 is mechanically linked directly to one end of the secondary branch 20.2.

Nonetheless, in another embodiment which is not illustrated in the figures of the present description, the inertial member may be mechanically linked to another element of the kinematic chain while remaining kinematically coupled to the secondary branch of the handle lever. In this case, the secondary branch forms the active portion of the handle lever enabling the actuation of the kinematic chain. For example, the inertial member may be mounted on the transmission lever.

Moreover, the inertial member 30 is preferably mounted movable in rotation on a free end of the secondary branch 20.2. To this end, preferably, the inertial member 30 and the secondary branch 20.2 comprise respectively first 36 and second 38 complementary rotational coupling means. The inertial member 30 is configured to be hingedly mounted on the secondary branch 20.2 thanks to these coupling means 36 and 38.

Furthermore, preferably, the inertial member 30 comprising a pivot axis X2 (FIG. 3) to be pivotally mounted on the secondary branch 20.2, the pivot axis extends transversely in an intermediate region located between the main body 32 and the blocking element 34 (FIG. 9B), for example along the incidence cut-edge. In this example, the rotational coupling means 36 comprises a hub body 40 forming a portion for receiving a pivot shaft 42 forming the complementary rotational coupling means 38.

In the illustrated example, the secondary branch 20.2 terminates in a lateral cheek 44 from which the pivot shaft 42 extends to laterally receive the inertial member 30. Preferably, the hub body 40 is mounted to freely pivot about the pivot shaft 42 carried by the free end of the secondary branch 20.2. In order to hold the hub body 40, the inertial member 30 has on its inner face 30B a set of stiffening ribs 48.

Preferably, the inertial member 30 is mounted on a free end of the secondary branch 20.2 such that the blocking element 34 extends in a longitudinal direction of the secondary branch 20.2 and the main body 32 extends freely opposite a front-end face of the secondary branch 20.2.

Referring to FIG. 9A, the secondary branch 20.2 comprises, according to a longitudinal main direction, an upper face and a lower face and lateral faces. The secondary branch 20.2 further comprises a lateral housing 46 formed by a clearance made in one of the lateral faces adapted to at least partially receive the blocking element 34 in its rest position.

Furthermore, preferably, the opening control device 10 comprises an elastic return member exerting a force on the inertial member 30, the latter being adapted to overcome the force exerted by the elastic return member (not shown in the figures) so as to pass from the rest position into the active position immobilizing the drive kinematic chain. In this example, the return member comprises a helical torsion spring shaped to be received coaxially around the hub body 40 of the inertial member 30.

In this first embodiment, the bottom of the base 12 further comprises a projecting relief 60 or a boss 60 shaped so as to cooperate with the blocking element 34 of the inertial member 30 by contact, in particular in this example, by contact of the lug 34E of the blocking element 34 against an apex of the relief 60 in the projecting deployed configuration of the blocking element 34.

Figure 7:
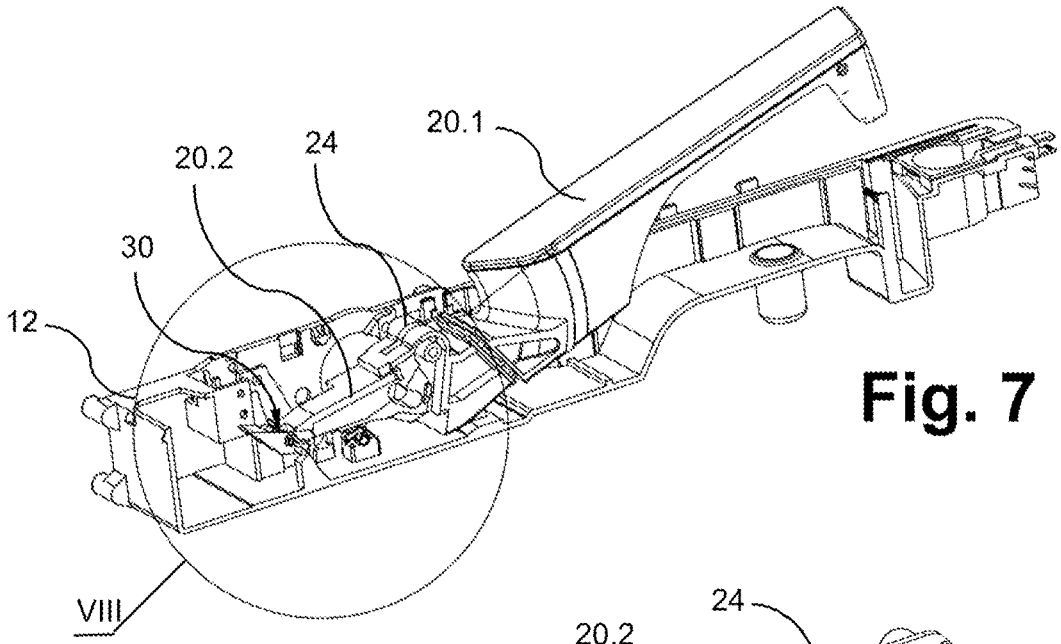
FIGS. 7 and 8 represent views respectively similar to FIGS. 1 to 3 in an ejected handle configuration subsequently to an impact.

When an impact occurs, as is the case in FIGS. 7 to 9, the inertial member 30 and the movable elements (handle 20, elements of the kinematic chain 100) undergo a strong acceleration which translates into a displacement represented by the arrow F1 in the direction opposite to that of the impact. During the impact, all movable elements of the opening control device 10 react more or less quickly depending on their inertia. By its mass and its geometry as well as its positioning, the inertial member 30 reacts more rapidly to the impact than the main branch 20.1 and the secondary branch 20.2 of the handle lever 20. The inertial member 30 then wedges against the relief 60 of the support 12 (FIG. 8) which prevents the handle lever 20 from continuing its movement and therefore from activating the kinematic chain 100 enabling unlocking of the latch. The blocking rod 34 of the inertial member 30 is engaged with the boss 60 interrupting the tilting of the secondary branch 20.2. Thus, the inertial member 30 blocks the movement of the handle lever 20 even before the active branch 20.2 of the handle 20 could have sufficiently made the transmission lever pivot so as to enable unlocking of the latch.

Figure 4:
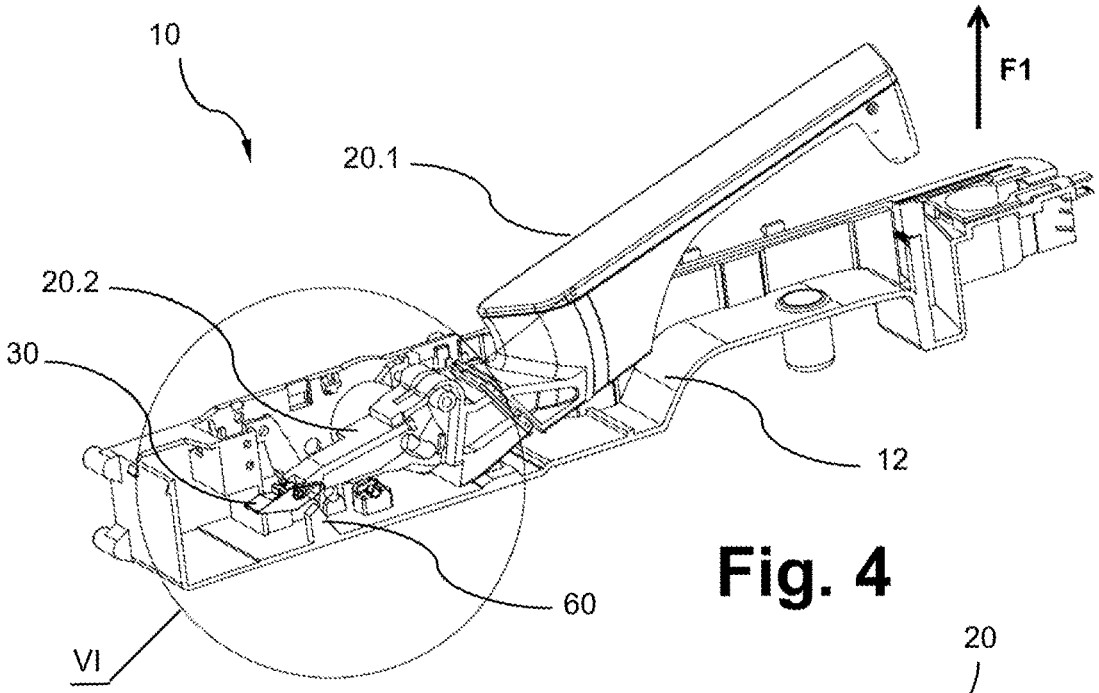
FIGS. 4 to 6 represent views respectively similar to FIGS. 1 to 3 in a deployed handle configuration in normal operation.
Figure 5:
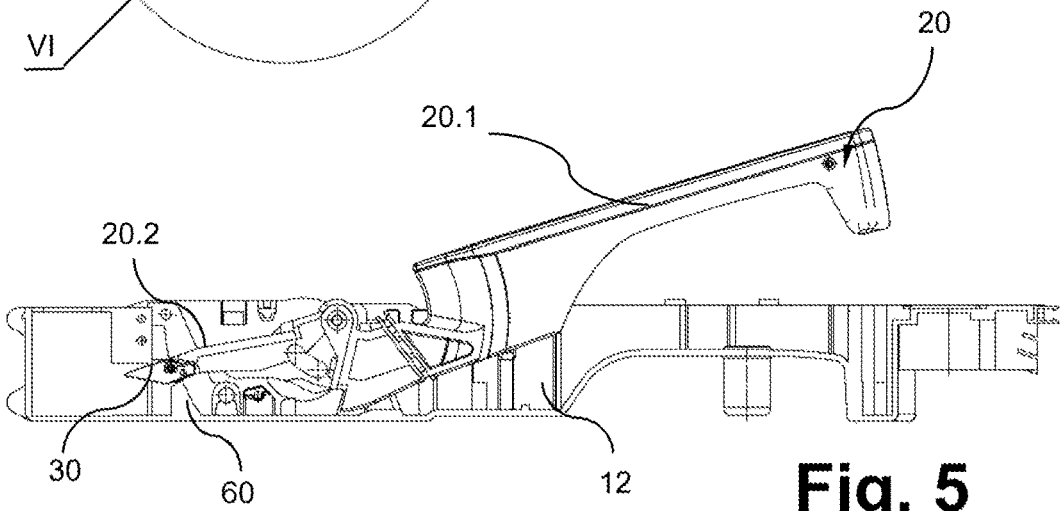
Figure 6:
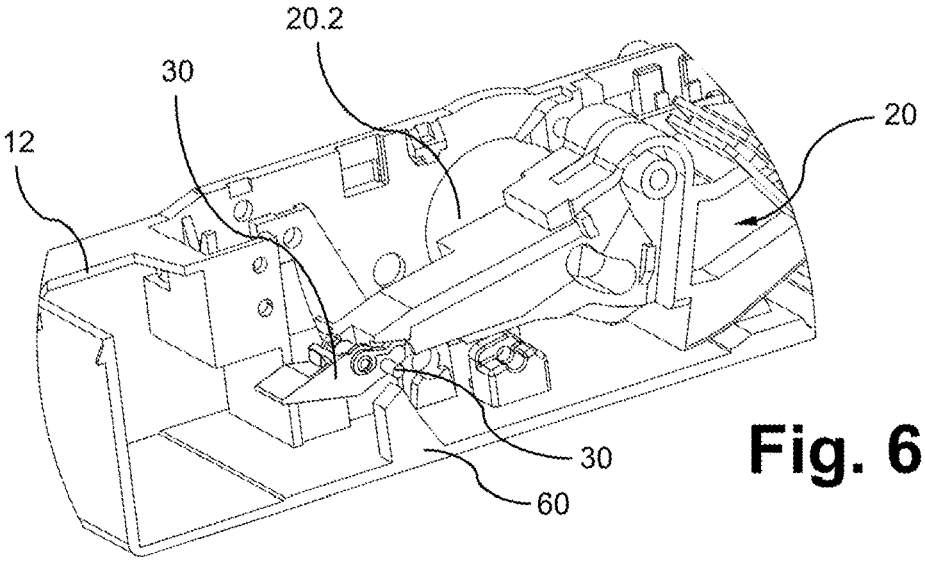

In order to avoid that, in a normal operation of the opening control device 10 illustrated for example by FIGS. 4 to 6, that is to say in absence of impact on the vehicle, the inertial member 30 inadvertently blocks the kinematic chain 100 thereby preventing the opening of the door leaf, the elastic return member returns the inertial member 30 in the normal operation position. In this example and as already specified above, the elastic return member comprises a helical torsion spring. Alternatively, the elastic return member may comprise a spiral compression spring, a spiral tension spring, a spiral torsion spring.

In this normal operation, the blocking element 34 of the inertial member 30 is positioned against the lower face of the secondary branch 20.2 such that the blocking element 34 cannot hinder the pivoting of the lever and consequently the driving of the kinematic chain 100 (FIG. 5).

There is represented in FIGS. 10 to 15, an opening control device according to a second embodiment of the invention. In this second embodiment, elements similar to those of the first embodiment bear identical references. In this second embodiment, the inertial member 30 is brought to cooperate with another element of the kinematic chain 100 such as a transmission lever.

As illustrated in FIGS. 10 and 11A, 11B and 11C, the kinematic chain 100 of the handle system 14 comprises a transmission lever 102 pivotally mounted about a transmission axis on the base 12.

To this end, in this example, the transmission lever 102 comprises a rotary cage 104 delimiting an inner cavity with a cylindrical general shape inside which a hub body 106 extends in a central manner. The transmission lever 102 also comprises a baseplate 108 extending at the periphery of the cage and comprising means for connecting the transmission lever to drive elements of the latch (not represented) such as for example linkage elements or a Bowden cable.

In the described example, the base 12 also comprises a rotational drive shaft 110 of the transmission lever 102. This shaft 110 is configured to be received inside the hub body 106 according to a shaft-hub type connection. For example, the hub body 106 and the shaft 110 comprise corrugated type complementary connecting regions.

Furthermore, the opening control device 10 also comprises an elastic return member 112 mounted inside the cage 104 of the transmission lever 102 so as to return the transmission lever 102 in the unlocked latch rest position. For example, the return member 112 comprises a helical torsion spring of the transmission lever 102.

Conventionally, in normal operation, the handle lever 20 being hinged on the base 12 comprises an active portion formed by the secondary branch 20.2, urging in rotation the transmission lever 102 also hinged on the base 12 which, in turn, will cause the displacement of the latch and the unlocking of the door leaf.

Figure 12:
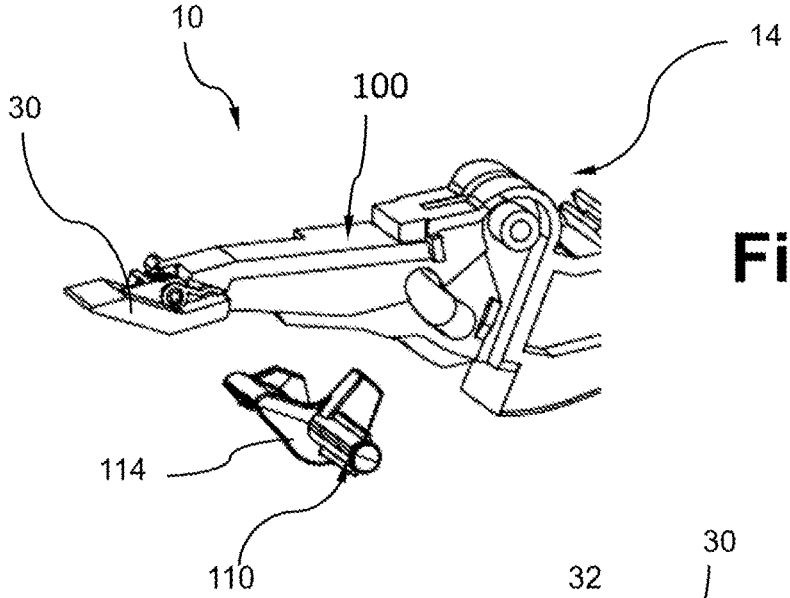
FIG. 12 is a partial perspective view of the handle lever and of the kinematic chain in an unblocked configuration of the kinematic chain.
Figure 13:
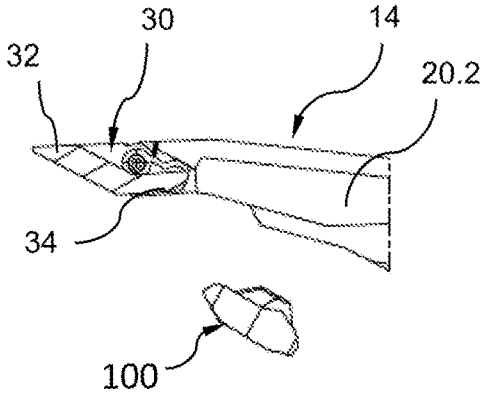
FIG. 13 is a partial longitudinal sectional view of FIG. 12.

In order to transmit the rotation of the handle lever 20 to the transmission lever 102, the rotation shaft of the transmission lever 110 comprises in this example a longitudinal extension rod about which the main axis provided with a fin 114 projecting so as to extend radially is configured to cooperate with a middle region 116 of the lower face of the secondary branch 20.2 of the handle lever 20 in normal operation (FIGS. 12 and 13). For example, the fin 114 comprises a curvilinear profile to match with the middle region of the secondary branch 20.2

Moreover, in this second embodiment, the blocking element 34 is represented according to a variant of the blocking element 34 described in connection with the first embodiment. Elements similar to the two variants are referred to by identical references.

In this variant, the inertial member 30 comprises a surface 34E for wedging or stopping the kinematic chain 100 by wedging or stopping the inertial member 30 with an element of the kinematic chain 100, herein the transmission lever 102. In this example, the element 34 is formed as a rectangular blocking tooth provided at the end of the wedge surface.

For example, the blocking element 34 is formed as a blocking tooth 34E with a rectangular or oval general shape configured to wedge against a relief, herein the transmission lever 102 only during the displacement of the member 30 by inertial effect.

Figure 14:
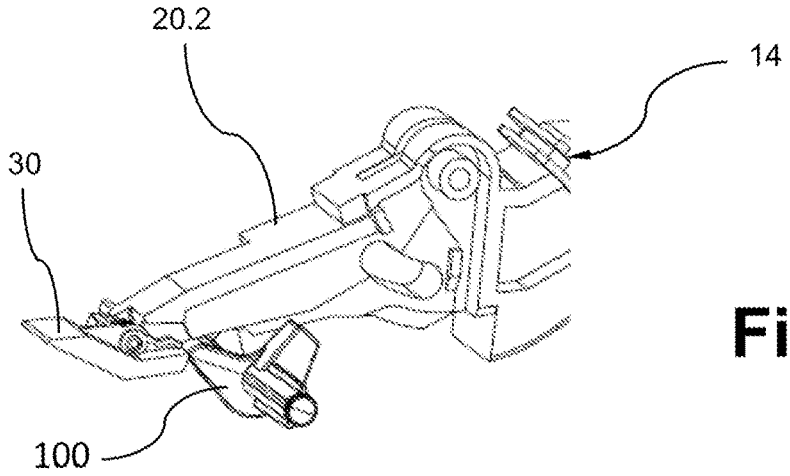
FIGS. 14 and 15 represent views similar to those of FIGS. 12 and 13 in a blocked configuration of the kinematic chain.
Figure 15:
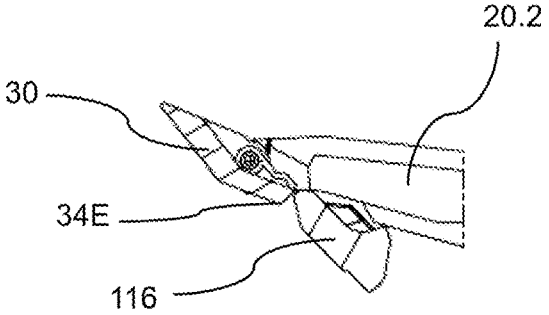
Figure 16:
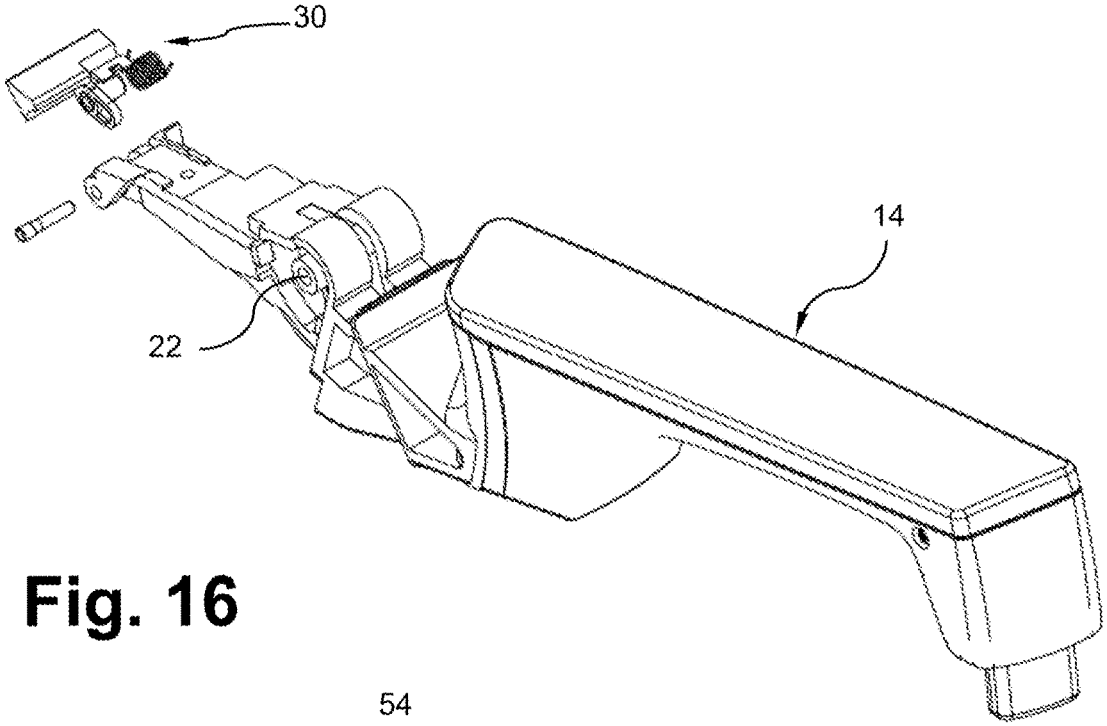
FIG. 16 represents an exploded perspective view of a handle lever provided with an inertial member according to a first variant of the first and second embodiments of the invention.
Figure 17:
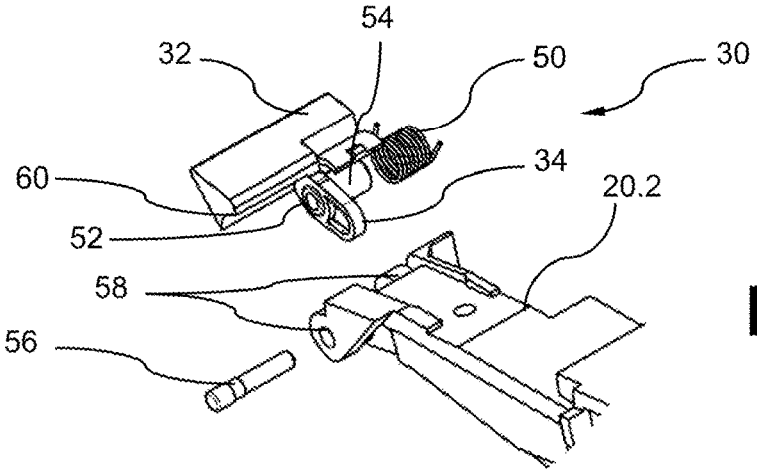
FIG. 17 represents an enlarged view of one end of the handle lever of FIG. 16.
Figure 18:
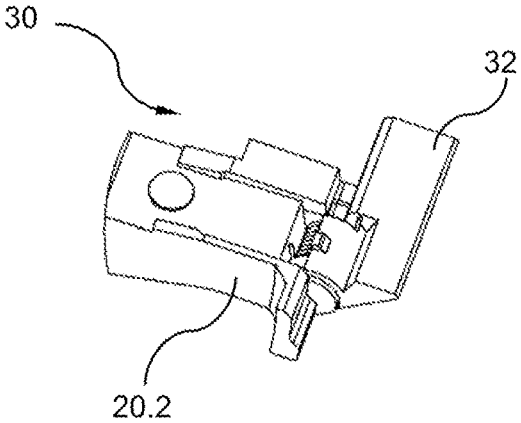
FIGS. 18 and 19 represent enlarged views of the inertial member of FIG. 17.
Figure 19:
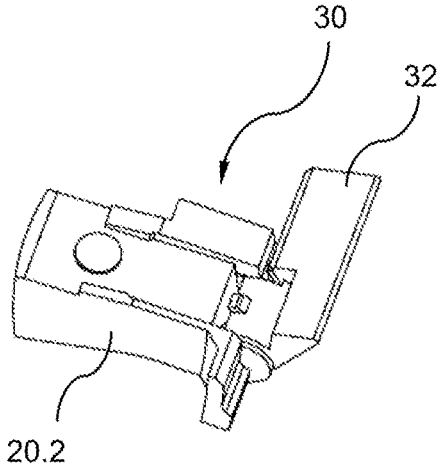
Figure 20:
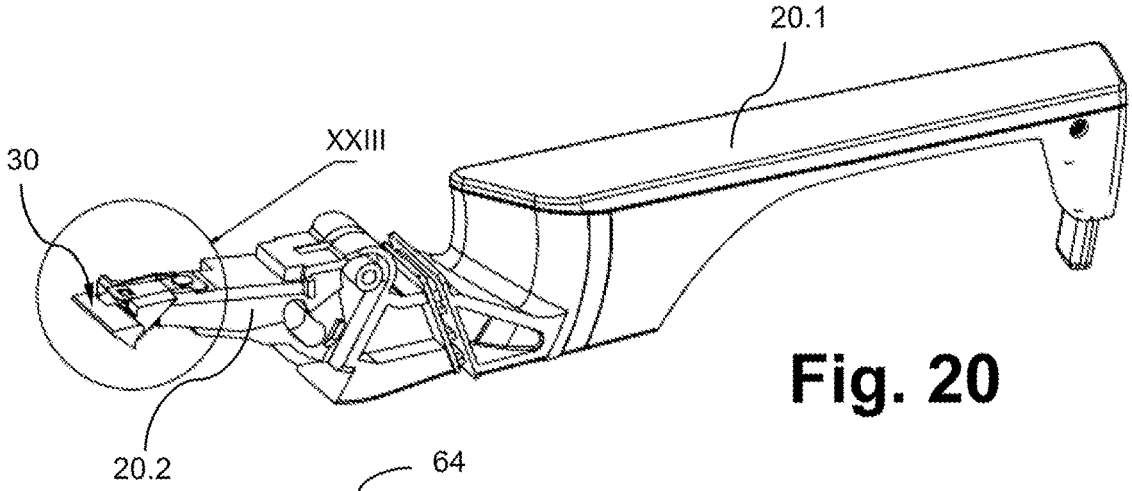
FIG. 20 represents a perspective view of a handle lever according to a second variant of the first and second embodiments of the invention.
Figure 21:
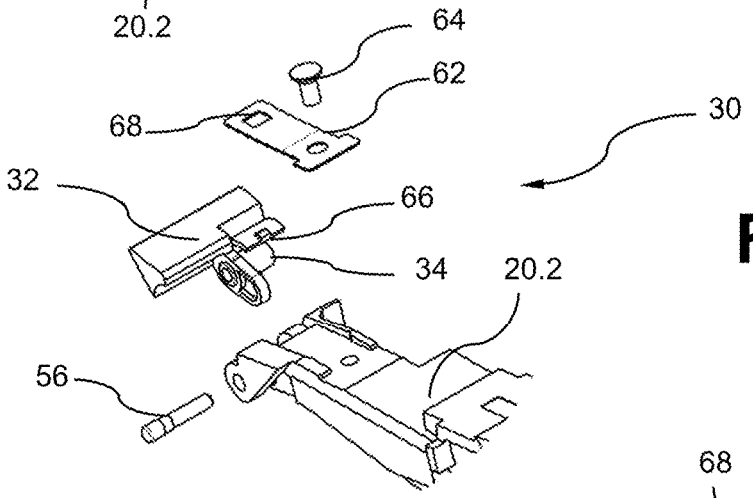
FIG. 21 is an exploded view of one end of the handle lever and of the inertial member represented in FIG. 20.
Figure 22:
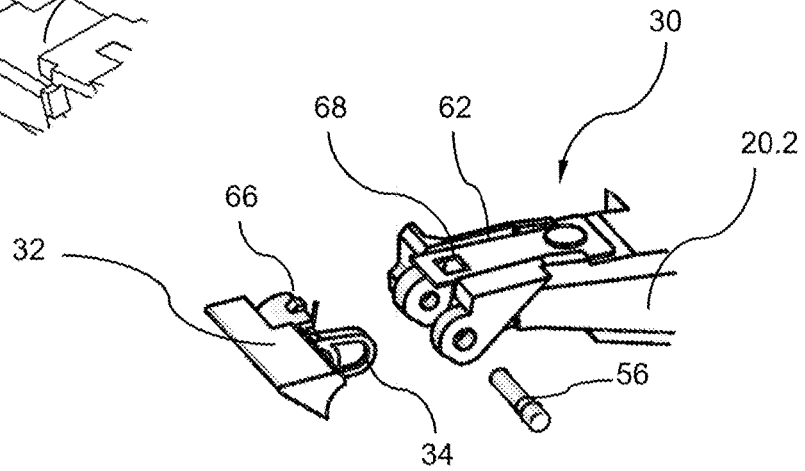
FIG. 22 is a view according to another viewpoint of the end of the handle lever and of the inertial member of FIG. 21.
Figure 23:
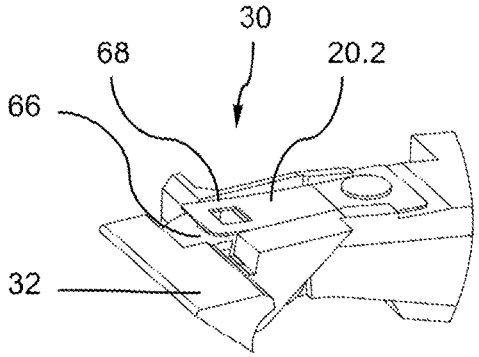
FIGS. 23 and 24 are views of the end of the handle lever and of the inertial member of FIG. 22 according to two distinct configurations.
Figure 24:
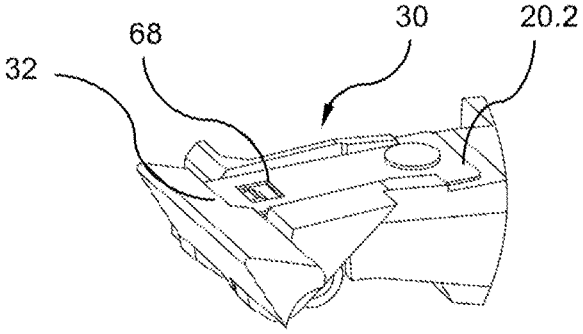

During an impact, illustrated in FIGS. 14 and 15, the blocking element 34 catches the radial fin 114 with its front wedge surface 34E in order to block the kinematic chain 100.

In FIGS. 16 to 19, there is represented a first variant of the handle system. In this first variant, the inertial member 30 has a main body forming the inertial mass 32 extended by a blocking element 34 in the form of an oblong tab. The tab has an oval general shape. The elastic return member of the inertial member 30 bears the reference 50.

The main body 32 has a general shape in form of a prism with a triangular base and the blocking element 34 extends transversally from the center of one of the longitudinal faces of the main body 32.

The blocking element 34 comprises an orifice 52 extended by a hollow sleeve 54 delimiting cylindrical bore for receiving a pivot rod 56. Furthermore, in this variant, the secondary branch 20.2 is provided at its end with two flanges 58 supporting the pivot rod 56 about which the inertial member 30 is hinged by engagement of the rod 56 inside of the cylindrical bore. For example, the elastic return member 50 also comprises a helical torsion spring shaped to be mounted around the peripheral outer surface of the hollow sleeve 54.

Furthermore, in order to guide the rotation of the inertial member 30 about the pivot rod 56, the main body 32 further comprises a housing 60 for guiding in rotation a pivot shaft, the guide housing 60 consists of at least one half-bearing provided with a semi-cylindrical recess.

A second variant is illustrated by FIGS. 20 to 24 which differs from the first variant only in that the handle system 14 ensures an irreversible blockage of the drive kinematic chain 100 after activation by inertia. Indeed, shortly after the impact, the handle 14 and the inertial member 30 are returned toward their original positions by their respective springs. In order to avoid a solely transitional and insufficient effect of the inertial member 30, it may be desirable to cause an irreversible blockage. Elements identical to the two variants bear unchanged references.

Thus, the secondary branch 20.2 comprises at its free end an elastic leaf 62 forming a spring leaf which can be biased along its longitudinal axis by buckling during the pivoting of the inertial member 30. In this example, this elastic leaf 62 extends axially at the end of the secondary branch 20.2. For example, the elastic leaf 62 is fastened with an anchoring pin 64 on the secondary branch 20.2. For example, the elastic leaf 62 is made of a material such as steel.

Furthermore, the inertial member 30 and the elastic leaf 62 are provided with complementary hooking means 66 and 68. The complementary hooking means 66 and 68 are adapted to cooperate by pivoting of the inertial member 30 against the action of its elastic return member. In particular, the complementary hooking means comprise for example a projecting lug 66 or protrusion on the inertial member 30 and a notch 68 formed at the end of the spring leaf 62.

We will now describe the main aspects of operation of a handle system according to the two embodiments previously described with reference to the block diagrams of FIGS. 25A to 25C on the one hand and FIGS. 26A to 26C on the other hand. The shape of the handles herein relates to a design different from those previously described with reference to FIGS. 1 to 24 (handle of a type which is not necessarily flush) but the operating principle remains the same.

Figure 25A:
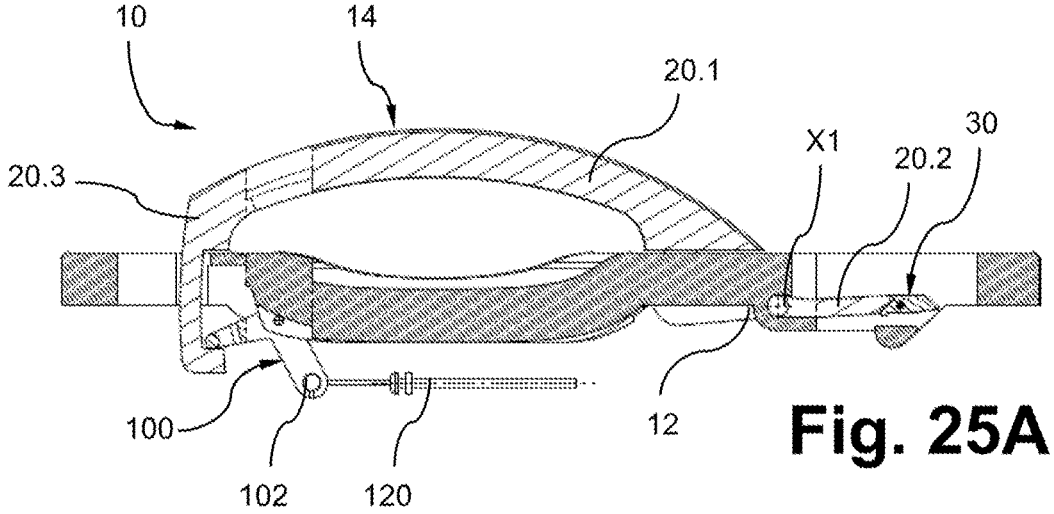
FIGS. 25A to 25C are schematic views illustrating the operating principle of an opening control device of a first design respectively in three distinct configurations.
Figure 25B:
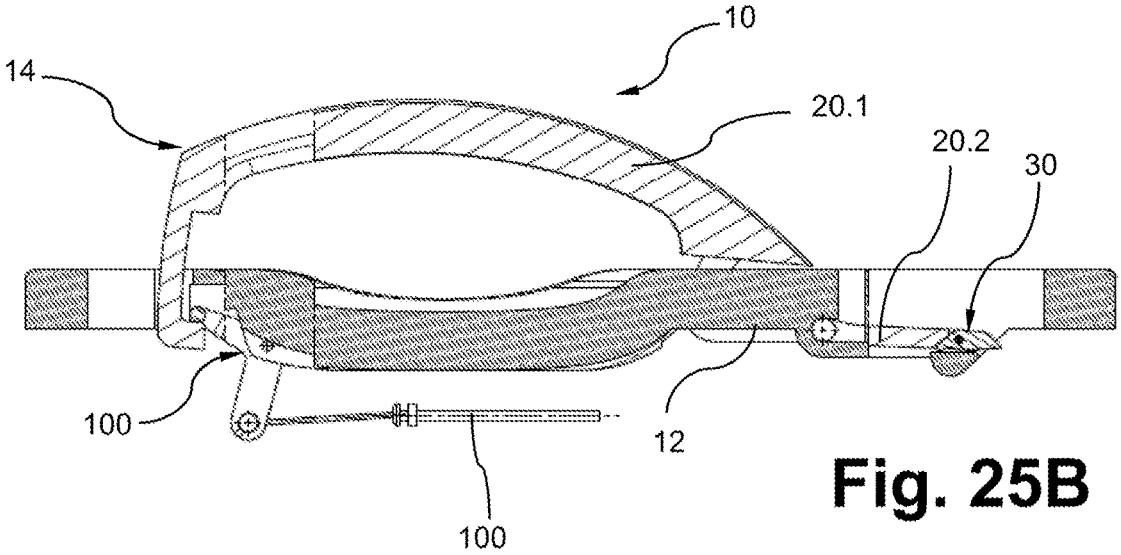
Figure 25C:
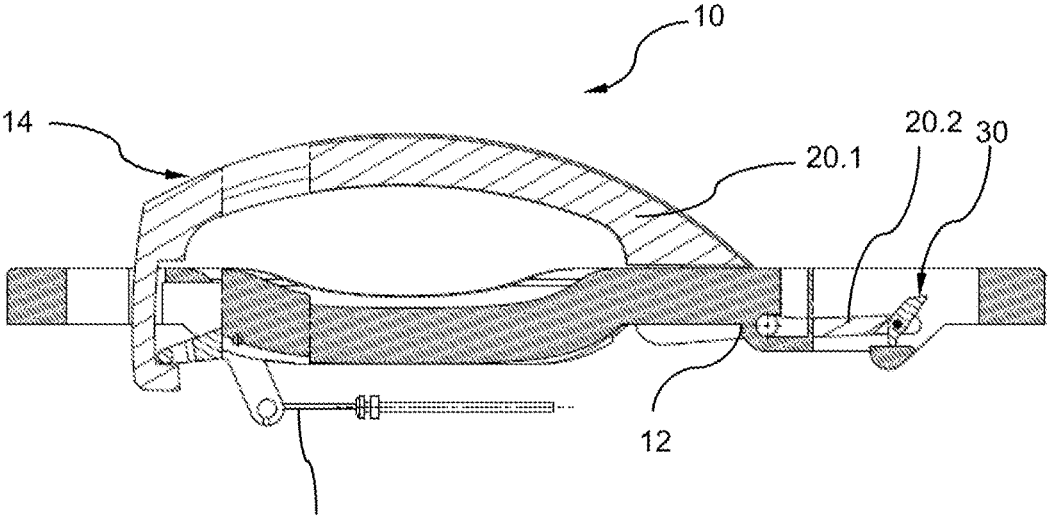

In FIGS. 25A to 25C, the gripping main branch 20.1 of the handle lever 220 comprises a hook-like shaped handle active portion 20.3 away from the handle pivot axis X1 which hooks to a transmission arm 102 to the Bowden cable of the latch 120. An end of the striker wire of the latch is mounted on the transmission arm 102. It should be noted that in this case, the secondary branch 20.2 does not form an element of the kinematic chain 100.

In the rest configuration illustrated in FIG. 25A, the inertial member 30 does not block the pivoting movement of the handle lever 20. The inertial member 30 is in a rest position.

When a user makes the handle lever 20 pivots in normal operation illustrated in FIG. 25B, the inertial member 30 is held in its rest configuration by the elastic return member, the acceleration generated by the action of the user being substantially insufficient to drive the inertial member 30 in its active configuration. The transmission lever 102 can then be driven in movement until causing the unlocking of the latch, in this case, by traction of the striker wire 120 or a linkage known per se.

During an impact, as illustrated in FIG. 25C, the inertial member 30 is driven in rotation by its moment of inertia and prevents complete pivoting of the handle lever 20 which prevents the actuation of the transmission arm 102.

Figure 26A:
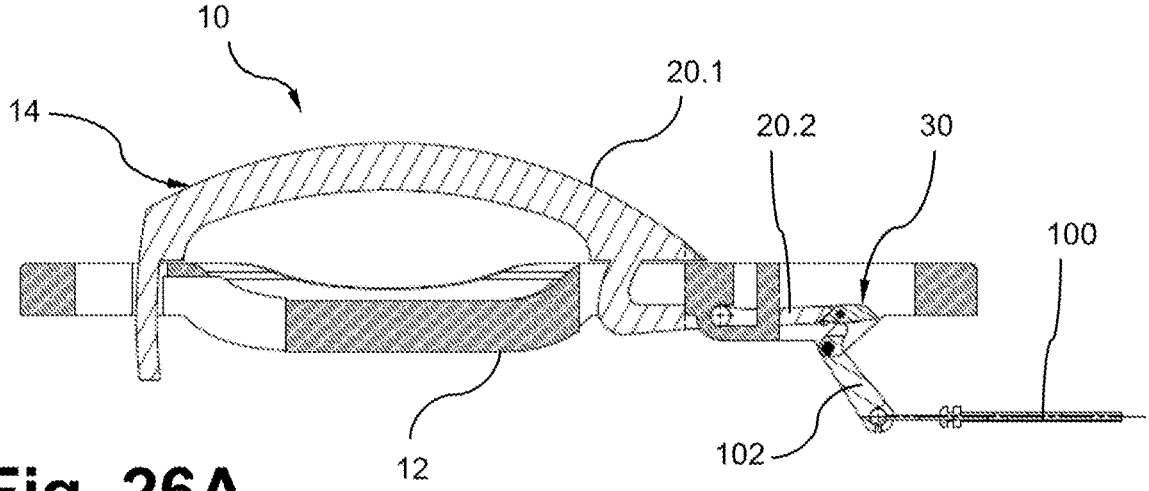
FIGS. 26A to 26C are schematic views illustrating the operating principle of an opening control device of a second design respectively in three distinct configurations.
Figure 26B:
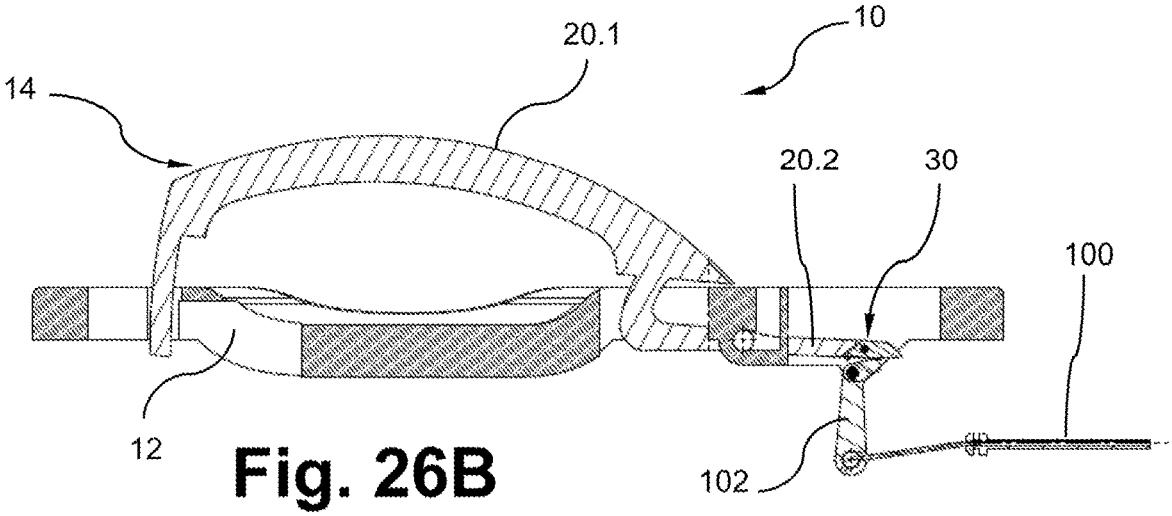
Figure 26C:
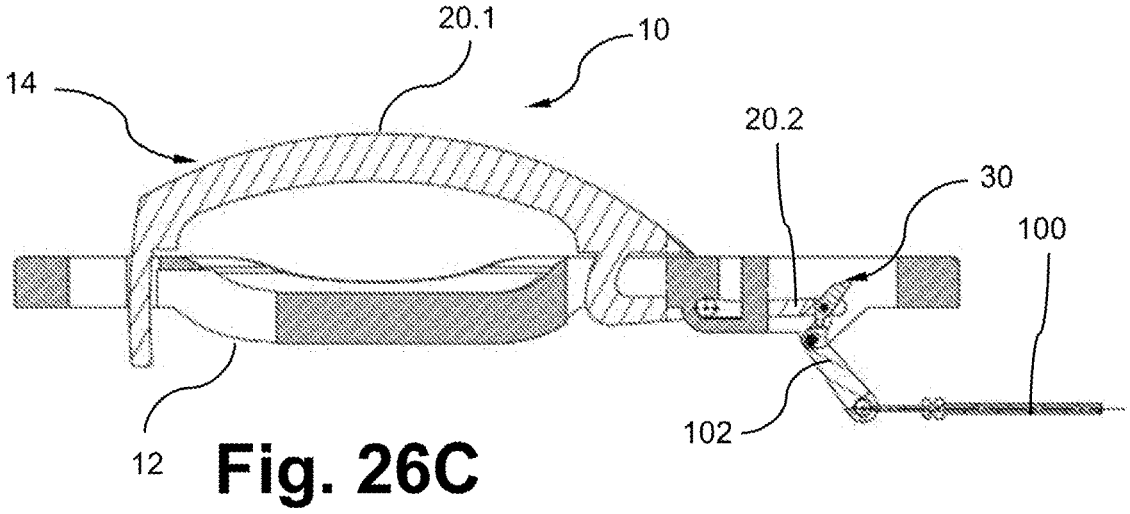

FIGS. 26A to 26C illustrate another embodiment. In this other embodiment, the handle lever 20 comprises an active branch formed by the extension secondary branch 20.2. This branch 20.2 is brought to actuate a transmission arm 102.

In this embodiment, the inertial member 30 is mounted at the end of the secondary branch 20.2 such that it is brought to cooperate by wedging on the transmission arm 102 in case of impact (FIG. 26C).

The invention is not limited to the previously described embodiments. Other embodiments within the reach of those skilled in the art may also be considered without departing from the scope of the invention defined by the claims hereinafter. Thus, in particular, modifying the detail shapes of the handle or of its active branch would not depart us from the scope of the invention.

Furthermore, the inertial member may be movably mounted on a movable element other than a transmission lever or a handle lever. The invention is not limited to an inertial member pivotally mounted on a movable element of the opening control device. The inertial member may be slidably mounted on a movable element of the opening control device, for example on the transmission lever, on the secondary branch or else on another movable lever of the kinematic chain.

The invention claimed is:

1. An opening control device for a door leaf of a motor vehicle comprising:

a base, a handle lever configured to be pivotally mounted on the base about a handle axis, comprising a main gripping branch and a secondary branch for extending the main branch each located on either side of the handle axis and a center of gravity located on the side of the main branch, one of the two branches forming an actuation branch, a set of elements, comprising movable element, forming a kinematic chain configured to transmit a movement from the handle lever to a latch of the opening control device to unlock the door leaf, the kinematic chain comprising at least the actuation branch of the handle lever, an inertial safety member, distinct from the movable elements from the set of elements and the handle lever, comprising a main body forming an inertial mass and a blocking element connected to the body and configured to block by inertial effect the transmission of movement by the kinematic chain, wherein the inertial safety member is kinematically coupled to the secondary branch of the handle lever and extends on the side of the secondary branch with respect to the handle axis, and wherein the inertial safety member is movably mounted on a free end of the secondary branch such that the blocking element extends in a longitudinal direction of the secondary branch and the main body extends freely opposite a front end face of the secondary branch.

2. The opening control device according to claim 1, wherein the inertial safety member comprising a pivot axis so as to be pivotally mounted on the secondary branch, the pivot axis extends transversely to the predefined direction in an intermediate region located between the main body and the blocking element.

3. The opening control device according to claim 1, wherein the inertial safety member is movably mounted directly on the secondary branch.

4. The opening control device according to claim 3 wherein the inertial safety member has a rest configuration folded back against a lower surface of the secondary branch and an active configuration deployed by inertial effect to project outwardly from the secondary branch.

5. The opening control device according to claim 1, wherein the inertial safety member comprises a first means for rotatably coupling with a complementary second rotational coupling means secured to the secondary branch.

6. The opening control device according to claim 1, wherein the inertial safety member delimits a lower profile which forms an obtuse angle such that the blocking element extends in a direction oblique with respect to the main body.

7. The opening control device according to claim 1, wherein the inertial safety member has a longitudinal section according to the direction of extension of the blocking element configured in an L- or V-shape with an obtuse apex angle.

8. The opening control device according to claim 1, wherein the blocking element is formed as a blocking tooth having a rectangular or oval general shape configured to be wedged against a relief only during the displacement of the inertial safety member by inertial effect.

9. The opening control device according to claim 1, wherein the blocking element comprises a blocking lug extending transversely and configured to abut against a relief only during the displacement of the inertial safety member by inertial effect and to circumvent the relief otherwise.

10. The opening control device according to claim 1, wherein the main body comprises a housing for guiding in rotation a pivot shaft, the guide housing consists of at least one half-bearing provided with a semi-cylindrical recess.

11. The opening control device according to claim 1, wherein the secondary branch terminates in a lateral cheek and a pivot shaft extending transversely to the lateral cheek about which the inertial safety member can pivot.

12. The opening control device according to claim 1, wherein the secondary branch terminates in two flanges supporting a rod about which the inertial safety member can pivot.

13. The opening control device according to claim 1, comprising an elastic leaf forming a spring which can be biased along its longitudinal axis by buckling during the displacement of the inertial safety member, the inertial safety member and the elastic leaf being provided with first and second complementary hooking means.

14. The opening control device according to claim 13, wherein the first and second hooking means comprise a protrusion and a notch for receiving the protrusion, the protrusion being adapted to engage into the notch during the pivoting of the inertial safety member so as to retain the inertial safety member.

15. The opening control device according to claim 1, comprising an elastic return member exerting a force on the inertial safety member, the latter being adapted to overcome the force exerted by the elastic return member by inertial effect.

16. The opening control device according to claim 1, wherein the inertial safety member is of the mono-stable type comprising a rest stable position, bi-stable and irreversible comprising two rest and active stable positions, the active position being irreversible, bi-stable and reversible comprising two rest and active stable positions, the active position being reversible.

* * * * *